US009855784B1

(12) United States Patent
Mayer

(10) Patent No.: US 9,855,784 B1
(45) Date of Patent: Jan. 2, 2018

(54) INTERACTIVE GREETING CARD WITH INFRARED SENSOR

(71) Applicant: American Greetings Corporation, Cleveland, OH (US)

(72) Inventor: David Mayer, Bay Village, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 15/219,169

(22) Filed: Jul. 25, 2016

(51) Int. Cl.
*G09F 1/00* (2006.01)
*B42D 15/02* (2006.01)

(52) U.S. Cl.
CPC ..... *B42D 15/022* (2013.01); *B42D 15/027* (2013.01); *G09F 1/00* (2013.01)

(58) Field of Classification Search
CPC ..... B42D 15/022
USPC ..... 40/124.03
See application file for complete search history.

(56) References Cited

U.S. PATENT DOCUMENTS 6,573,880 B1 6/2003 Simoni et al.
8,011,122 B2 9/2011 Clegg et al.
8,341,858 B2 1/2013 Clegg et al.
2007/0072162 A1 3/2007 Honadel
2007/0153638 A1 7/2007 Lebbing
2009/0126239 A1* 5/2009 Clegg ..... G09F 1/00 40/124.03
2010/0281719 A1 11/2010 Driessen
2011/0154698 A1* 6/2011 Lin ..... B42D 15/022 40/124.03
2012/0266503 A1* 10/2012 Sapp ..... B42D 15/022 40/124.03
2013/0000164 A1 1/2013 Shah et al.
2013/0119652 A1* 5/2013 Stone ..... B42D 1/007 283/72
2013/0177291 A1 7/2013 Clegg et al.
2013/0239448 A1 9/2013 Davis
2014/0150307 A1* 6/2014 Ehrlich ..... B42D 15/022 40/124.03

* cited by examiner

*Primary Examiner* — Kristina N Junge
(74) *Attorney, Agent, or Firm* — Christine Flanagan

(57) ABSTRACT

The interactive greeting card of the present invention combines a greeting card with IR sensor to trigger effects upon the greeting card recipient interacting with the IR sensor. The greeting card contains a hole, opening or aperture therethrough, into which a user may insert his or her finger to trigger one or more special effects such as audio replay, motorized movement of one or more mobile objects attached to the greeting card, or other special effects.

18 Claims, 4 Drawing Sheets

INTERACTIVE GREETING CARD WITH INFRARED SENSOR

RELATED APPLICATIONS

There are no applications related to this application.

FIELD OF THE INVENTION

The present invention is in the field of social expression products and more specifically to an interactive greeting card with infrared (IR) sensor used to trigger effects upon detection of a light wavelength in the IR spectrum by a light sensor.

SUMMARY OF THE INVENTION

The interactive greeting card of the present disclosure and related inventions includes a greeting card body having one or more panels, a mobile object attached to the greeting card body, a motor attached to the greeting card body, the motor operative to cause movement of the mobile object, and an infrared sensor. When a user places his or her finger detects an increase in heat, it triggers the motor module which in turn causes movement of the mobile object.

DETAILED DESCRIPTION OF PREFERRED AND ALTERNATE EMBODIMENTS

Figure 1:
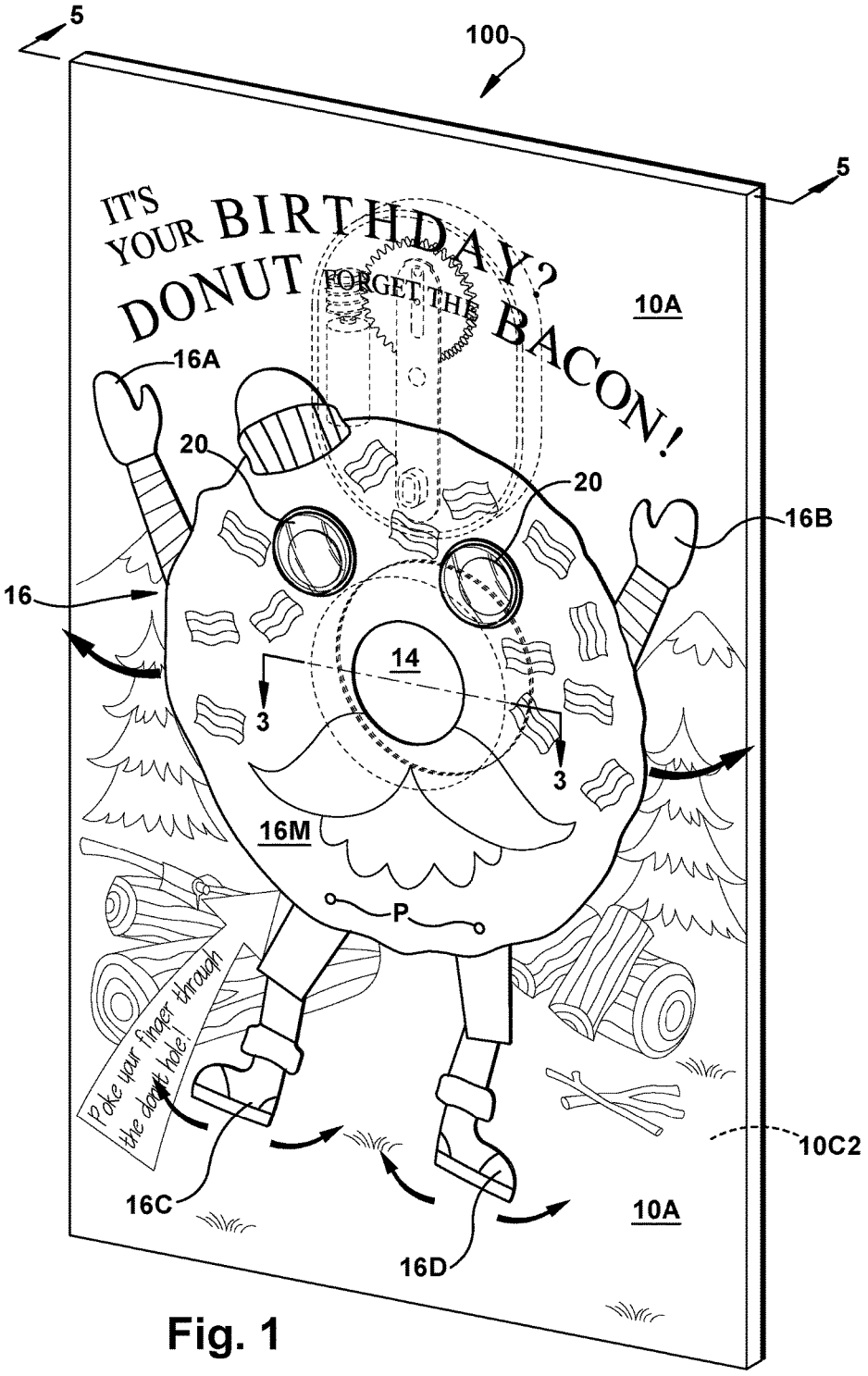
FIG. 1 is a perspective view of the front of the greeting card of the present invention, in a closed position.

The greeting card 100 of the present disclosure and related inventions provides a fun, user-interactive greeting card with infrared (IR) sensor 12 for detecting when a user's finger is inserted through an opening (also referred to herein interchangeably as a hole or an aperture) 14 in the greeting card 100. The IR sensor 10 operates as a trigger or switch which controls activation of a motor 18 and sound module for producing special effects.

The greeting card body 10 includes a series of greeting card panels which are wrapped around a frame structure which encloses the electronic components of the greeting card 100. In a preferred embodiment, the greeting card body 100 contains three main greeting card panels10A, 10B, 10C which are connected via various fold lines and/or one or more minor side tab panels. The first main greeting card panel 10A contains four minor side tab panels attached thereto via fold lines along each of the four outer edges of the first main panel 10A. The second main panel 10B is attached to the minor side tab panel that attached to the right side edge of the first main panel 10A and a third main panel 10C is attached to the second main panel 10B along a main vertical fold line along the right side edge of the second main panel 10B. Each main greeting card panel 10A, 10B, 10C and each minor side tab panel contains a front surface and a rear surface opposite the front surface. Each of the main greeting card panels 10A, 10B, 10C and each minor side table panel are substantially rectangular. The frame structure located within the greeting card body 10 contains two vertical sides and two horizontal sides connected in a closed rectangular shape with a large opening therebetween. The rear surface of the first main greeting card panel 10A is attached to a front surface of the frame and each of the four side tab panels is folded around the perimeter surface of the frame along all four sides, thereby covering the front and perimeter surfaces of the frame. The electronic components of the greeting card (discussed in further detail below) are attached either to the rear surface of the first main greeting card panel 10A between the opening in the frame or to a separate backer panel which is then inserted into the opening within the frame. The second greeting card panel 10B is then folded beneath the first greeting card panel 10A to cover the rear surface of the frame. The rear surface of the second greeting card panel 10B is in direct contact with the rear surface of the frame. The third main greeting card panel 10C is then folded along the fold line between the second 10B and third 10C main greeting card panels such that the front surface of the third main greeting card panel 10C and the front surface of the second main greeting card panel 10B are directly facing each other. Therefore, the front surface of the first main greeting card panel 10A serves as the front cover of the greeting card body 10, the front surface of the second main greeting card 10B panel serves as the inside left panel of the greeting card body 10, the front surface of the third main greeting card panel 10C1 serves as the inside right panel of the greeting card body 10 and the rear surface of the third main greeting card panel 10C2 serves as the back cover of the greeting card body 10. When the greeting card body 10 is fully assembled, it operates as a typical two panel greeting card wherein folding and unfolding the front cover 10A about the vertical fold line between the second 10B and third 10C main greeting card panels opens and closes the greeting card 100. Each of the front and rear surfaces of each of the main greeting card panels 10A, 10B, 10C and the minor tab panels can contain printing thereon which may include, but is not limited to photos, drawings, pictures, text sentiment or any other type of printable content. The main panels 10A, 10B, 10C of the greeting card body 10 may also contain embellishments attached thereto such as googly eyes, gems, sequins, feathers or any other such embellishments. As will be discussed in further detail below, each of the three main greeting card panels 10A, 10B, 10C contains a circular opening therethrough. While the greeting card body 10 has been described herein as having a particular number of main and side tab panels and fold lines, the greeting card body 10 may have any number of panels and fold lines and may be oriented or configured in various configurations different from what has been described herein with respect to a preferred embodiment. In a preferred embodiment, the frame structure is made of foam and the greeting card panels are made of paperboard, however other materials have been contemplated and may be used in place of the materials described herein with respect to the preferred embodiment and are considered to be within the scope of the present invention.

Figure 2:
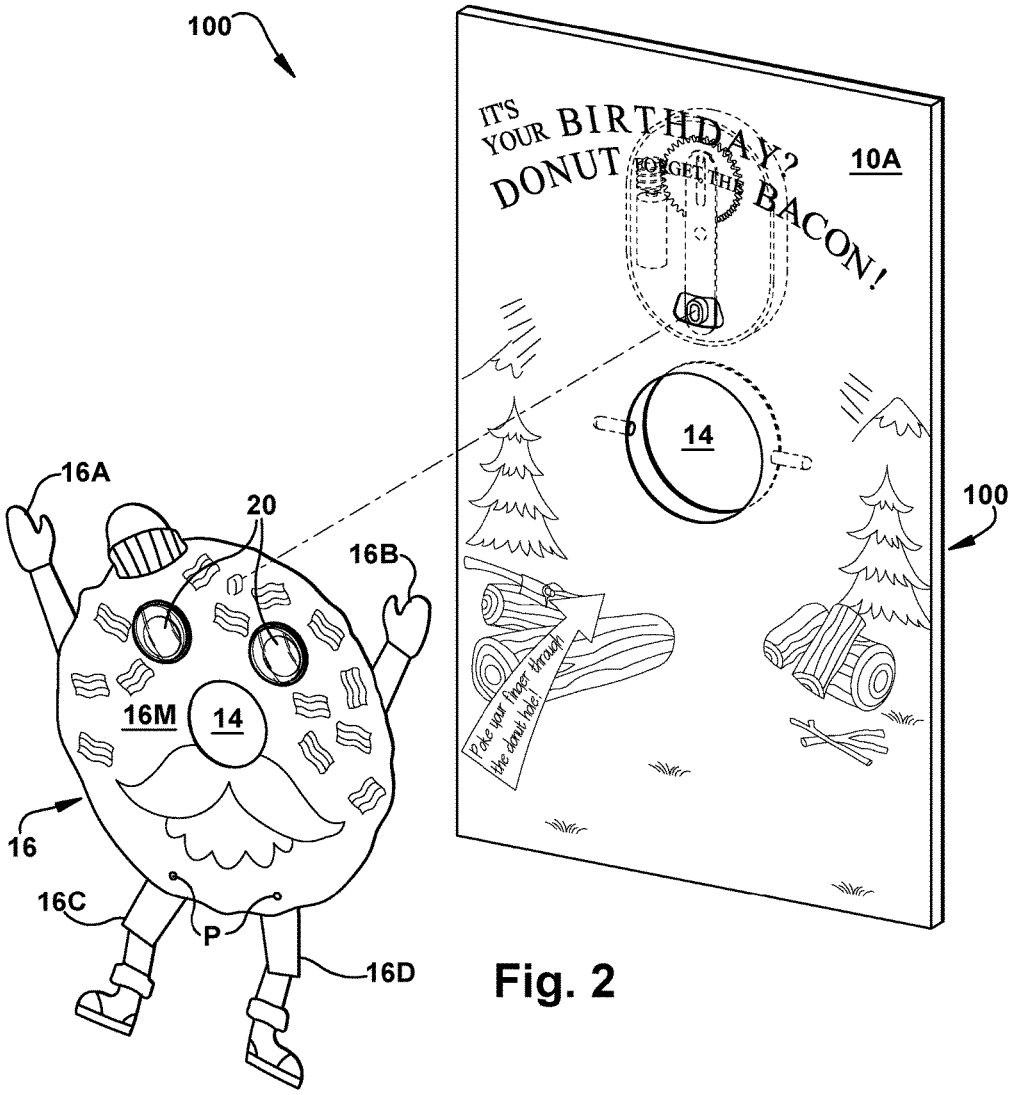
FIG. 2 is a partially exploded view of the greeting card of FIG. 1.

A mobile object 16 is attached to a front surface 10A of the greeting card body 10, although the object 16 may be attached to any of the panels 10A, 10B, 10C of the greeting card body 10. In a preferred embodiment, the mobile object 16 is a substantially circular die cut shape having a circular opening 12 through the center thereof (which lines up or corresponds with the opening 12 through the panels of the greeting card body 10), which is designed to resemble a donut, bagel or similar pastry (collectively referred to herein as "donut"). The circular or main portion of the die cut shape 16M contains printing thereon which gives the donut animate features including but not limited to: eyes, nose, mouth, ears, hair and moustache. It may also include additional features such as a hat or other type of headwear. Instead of printing, embellishments may be used to signify the body parts or other objects such as googly eyes 20 which are small plastic craft supplies used to imitate eyeballs including a white plastic card backing covered by a clear, hard plastic shell, encapsulating a black plastic disk. The inner black disk is able to move around freely within the larger clear plastic shell thereby making the eyes 20 appear to move when they are tilted, moved or shaken. One or more separate minor die cut shapes 16A, 16B, 16C, 16D may be attached to the main circular portion 16M of the mobile object 16. These separate die cut shapes 16A, 16B, 16C, 16D may resemble other body parts such as arms (16A, 16B) and legs (16C, 16D) to further animate the mobile object 16. One or more of the minor die cuts shape 16A, 16B, 16C, 16D is attached to the main circular portion 16M of the die cut shape 16 at a pivot point P such that the minor die cut shape may pivot (either partially or fully) about the attachment point P with respect to the main circular portion 16M of the mobile object 16. Alternatively, one or more of the minor die cut shapes 16A, 16B, 16C, 16D may be attached at a fixed point to the main circular portion 16M of the mobile object 16 such that it is not moveable or pivotable with respect to the main circular portion 16M. Regardless of the type of attachment mechanism, the minor die cut shapes 16A, 16B, 16C, 16D are attached to the main circular portion 16M of the mobile object 16 through the rear surface thereof so that it appears the minor die cut shapes 16A, 16B, 16C, 16D are naturally attached or connected to the main circular portion 16M of the mobile object 16 and the connection or attachment point is not visible from the front surface of the mobile object 16. In a preferred embodiment, as shown in FIGS. 1 and 2, the main circular portion (donut portion) 16M of the mobile object 16 contains four minor die cut shapes 16A, 16B, 16C, 16D attached thereto. Two of the minor die cuts shapes 16C, 16D are shaped and printed to appear as legs (with feet) and are attached to a lower portion of the main circular portion 16M of the mobile object 16 at a pivot point P. The other two minor die cut shapes 16A, 16B are shaped and printed to appear as arms (with hands) and are fixedly attached to an upper portion of the main circular portion 16M of the mobile object 16. The main circular portion 16M of the mobile object 16 is connected or attached to a motor module 18 which is contained within a cavity (created by the panels of the greeting card body 10 and the frame structure) within the greeting card through a small opening in at least one of the greeting card panels 10A, 10B, 10C. As mentioned above, in a preferred embodiment, the mobile object 16 is attached to the front cover 10A of the greeting card body 10. The mobile object 16 may be attached or connected directly to the motor 18 or may be attached or connected to the motor 18 via a connection arm or other connection mechanism. The connection or attachment point between the motor 18 and the main circular portion 16M of the mobile object 16 is located in an upper portion of the main circular portion 16M of the mobile object 16 between the two minor die cut shapes 16A, 16B. When the motor module 18 is activated, it effects movement of the mobile object 16 causing it to move in a bouncing, up-and-down direction or a lateral side-by-side direction. The two die cut shapes 16C, 16D which are attached to the circular portion via a pivot point P and which represent the legs (and feet) and which are attached to a lower portion of the main circular potion 16M of the mobile object 16 also move separately and independently about each pivot point P with respect to the circular portion 16M of the mobile object 16. The two minor die cut shapes may be a single, contiguous die cut shape or they may be made of two or more separate die cut shapes that are themselves attached together at a pivot point so that they can move about said pivot point. The two die cut shapes 16A, 16B which represent the arms do not move independently but only along with the main circular portion 16M to which they are attached. In a preferred embodiment, the mobile object 16 is made of paperboard, however other materials, such as plastic, cardboard, silicone, wood or other materials may be used in addition to or in place of the paperboard shapes. While the mobile object 16 has been described herein as including one or more die cut shapes, other forms of mobile objects, such as other three dimensional attachments may be used. Minor attachments may or may not be attached to the mobile objects and may or may not be pivotable or moveable with respect to the mobile object 16.

The electronic components of the greeting card 100 of the present disclosure and related inventions include, but are not limited to a printed circuit board 22, integrated circuit chip, controller, speaker 24, power source 26, such as one or more small cell batteries, motor 18 and sound modules, memory or electronic storage device, switch 12 and various wires and circuitry which connect the various components. These types of electronics are known to one having skill in the art and are not described in further detail for that reason. As noted above, the motor 18 effects movement of the mobile object 16 to which it is attached through an opening in one or more of the main greeting card panels 10A, 10B, 10C of the greeting card body 10. The motor 18 may be of the type shown in FIG. 5, having a rotating gear mechanism 18A that when activated turns a circular gear 18B, which is in turn attached to a connecting rod 18C. The mobile object 16 is attached to the connecting rod 18C. While this particular type of motor is described herein and shown in the figures, other types of miniature motors may be used to affect up-and-down or lateral reciprocating motion. Alternate motors may also be used to effect circular or spinning motion. The sound module contains at least one audio file in memory to be replayed through the speaker 24 upon activation of the sound module via the IR sensor 12 (to be discussed in further detail below). The audio file may contain one or more sound clips, one or more songs or musical arrangements or any other recordable sound. The sound module may be programmed to replay the same clip each time the sound module is activated or it may play different clips in a predetermined or random order each time the sound module is activated.

Figure 3:
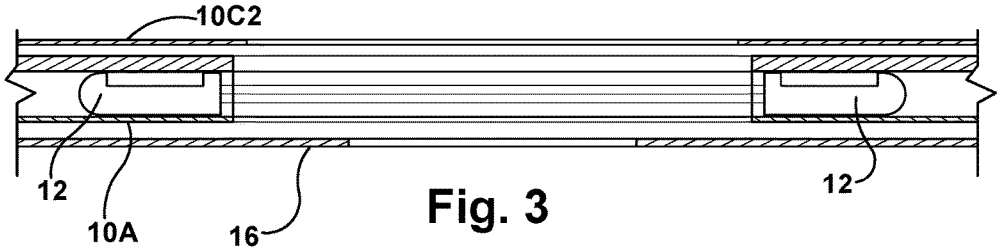
FIG. 3 is a cross-sectional view of the greeting card of FIG. 1 from the perspective of arrows 3-3.
Figure 4:
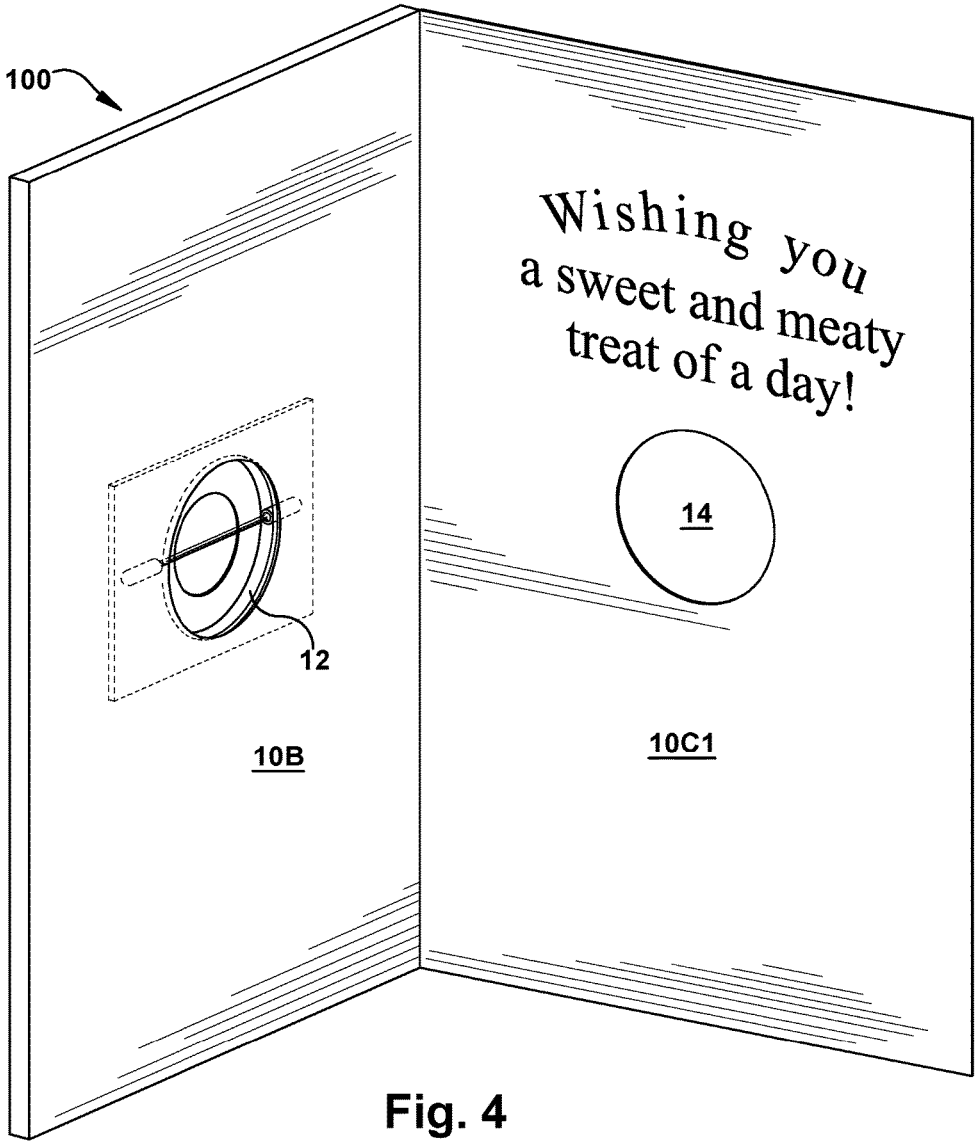
FIG. 4 is a perspective view of the greeting card of FIG. 1, in an open position.
Figure 5:
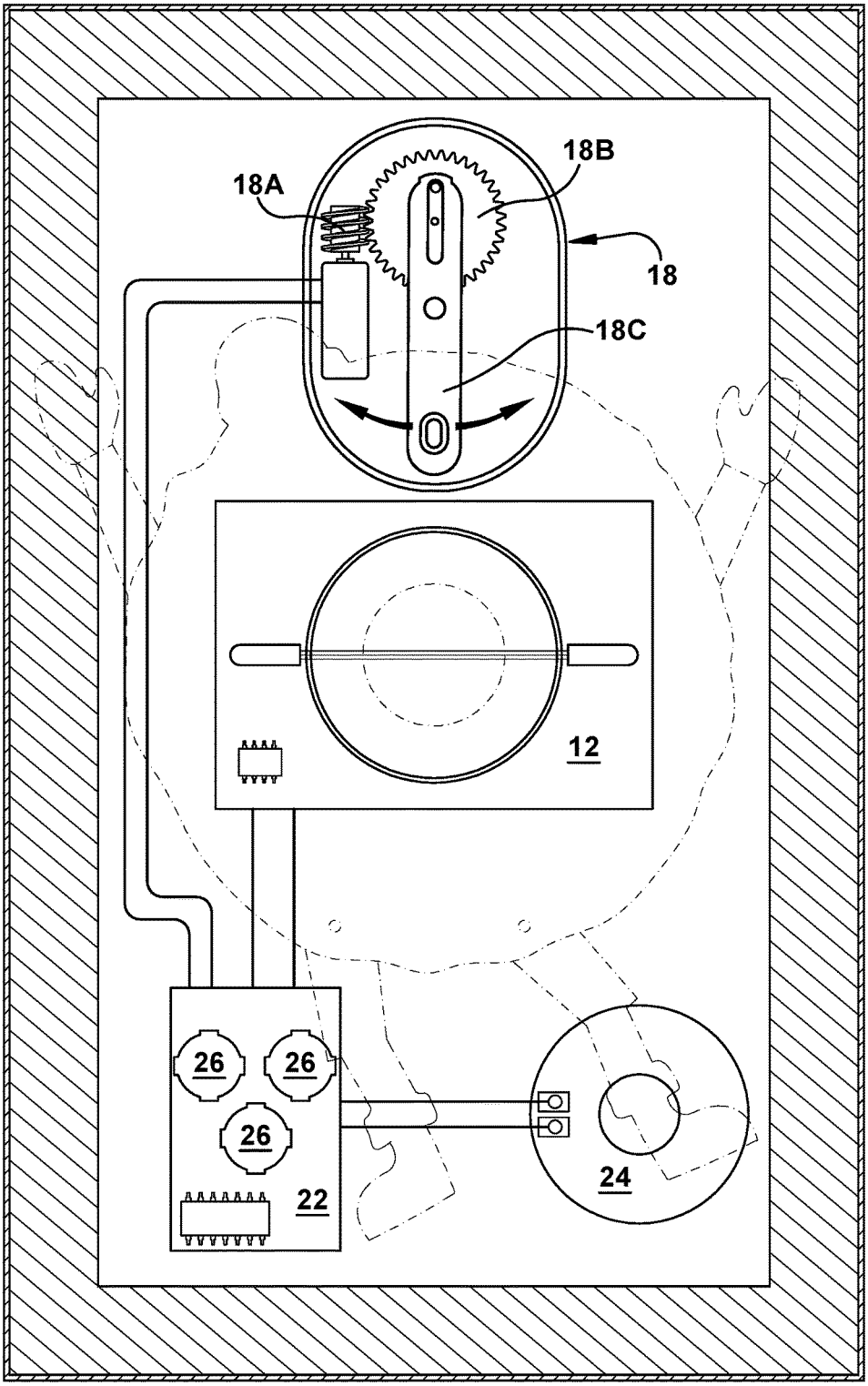
FIG. 5 is a front view of the greeting card of FIG. 1 from the perspective of arrows 5-5.

In a preferred embodiment, the switch which triggers activation of the sound and motor 18 modules is an IR sensor switch 12. An IR sensor 12 is an electronic device which emits and/or detects infrared radiation in order to sense some aspects of its surroundings. IR sensors can measure the heat of an object as well as detect motion. All objects emit some form of thermal radiation, usually in the infrared spectrum. This radiation is invisible to the naked eye but can be detected by an IR sensor that detects and interprets it. The infrared sensor is made of pyroelectric materials that are integrated into a circuit board. Radiation enters and reaches the sensor itself at the center of the device. As shown in FIGS. 3, 4 and 5, the IR sensor 12 contains an opening 14 which lines up with or corresponds with the opening 14 in the main panels 10A, 10B, 10C of the greeting card body 10. The IR sensor 12 remembers how an areas infrared radiation appears and a sudden change, especially one that moves, will change the way electricity goes from the pyrotechnic materials through the rest of the circuit. Therefore, when the IR sensor 12 detects an increase in heat of a small part of its field of view, such as by, for example, a user placing his or her finger in the hole or opening 14 in the center of the greeting card (and IR sensor), it triggers the sound and motor 18 modules connected thereto. In a preferred embodiment, the sound and motor 18 modules are triggered simultaneously by the IR sensor switch 12, although in other embodiments, the sound and motor 18 modules may be triggered or activated separately by the switch device or by different switch devices (which may be the same type or different).

In operation, a user receives the greeting card 100. A removable sticker or permanent printing directly on the greeting card body 10 may instruct the user to "poke your finger through the hole". When the user inserts his or her finger into the hole 14 (which goes through the main greeting card panels 10A, 10B, 10C, the mobile object 16 and the sensor 12), the sound and motor 18 module are activated simultaneously thereby emitting audio through the speaker 24 (via the sound module) and effecting movement of the mobile object 16 (via the motor module 18). In a preferred embodiment, the IR sensor switch 12 functions as an on/off switch wherein a user inserting his/her finger into the hole 14 in the greeting card 100 activates the sound and motor 18 modules and removing and subsequently inserting his/her finger into the hole 14 a second time, while the sound and motor 18 modules are still activated, will turn off or deactivate the sound and motor 18 modules. If the user does not re-insert his or her finger into the hole 14 during activation of the sound and motor 18 modules, each module may be activated for a predetermined amount of time before being automatically deactivated. The predetermined amount of time may be, for example, fifteen (15) seconds, less than fifteen (15) seconds or greater than fifteen (15) seconds.

In alternate embodiments, the mobile object 16 and IR sensor 12 (as described above) may be used in connection with a gift bag or gift box, wherein the sensor 12 and other electronic components are contained within a cavity in the gift bag or box and the mobile object 16 is attached or connected to an outer surface thereof. The greeting card, gift bag or gift box may additionally contain a microphone and recording module so that users can record and save personal messages to be replayed upon the gift card, bag or box recipient inserting his or her finger into the hole therein. The greeting card, bag or box may also contain additional special effects such as lights, confetti, pop-up device, pop-up gift card holder or other special effect to be triggered by the IR sensor switch (or other such switch).

While the greeting card of the present disclosure and related inventions has been described herein with respect to a preferred embodiment, nothing stated herein or shown in the figures is intended to limit the invention in any way. The type of greeting card body configuration, the electronic components, the form of the mobile object, the contents of the sound module, the form of the motor module and connection to the mobile object, the type and number of mobile objects, and the type and number of switches may be varied, modified or changed while still remaining within the scope of the present invention.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

What is claimed is:

1. An interactive greeting card comprising:

a greeting card body having one or more panels, each of the one or more panels having an opening therethrough;

a mobile object attached to the greeting card body, the mobile object having an opening therethrough;

a motor attached to the greeting card body, the motor operative to cause movement of the mobile object;

an infrared sensor contained within the greeting card body;

wherein the infrared sensor detects an increase in heat when a finger or other object is inserted into the opening in each of the one or more panels of the greeting card body and mobile object, thereby activating the motor which causes movement of the mobile object.

2. The interactive greeting card of claim 1 further comprising a sound module attached to the greeting card body, the sound module having at least one audio file stored thereon and operative to replay said audio file through a speaker.

3. The interactive greeting card of claim 2, wherein when the infrared sensor detects heat, it also triggers the sound module.

4. The interactive greeting card of claim 1, wherein the infrared sensor contains a circular opening through which a user's finger can be inserted.

5. The interactive greeting card of claim 1, wherein the mobile object contains one or more attachments connected thereto at a pivot point.

6. An interactive greeting card comprising:

a multi-panel greeting card body having an opening therethrough;

an infrared sensor contained within the multi-panel greeting card body;

a mobile object attached to the multi-panel greeting card body, the mobile object having an opening therethrough;

a motor contained within the multi-panel greeting card body and attached to the mobile object;

wherein the infrared sensor activates the motor causing movement of the mobile object when a finger or other object is inserted into the opening through the multi-panel greeting card body and mobile object.

7. The interactive greeting card of claim 6, wherein the infrared sensor surrounds the opening in the multi-panel greeting card body.

8. The interactive greeting card of claim 6 further comprising a sound module contained within the multi-panel greeting card body, the sound module operative to store and playback at least one audio file.

9. The interactive greeting card of claim 8, wherein the infrared sensor controls activation of the sound module.

10. The interactive greeting card of claim 6, wherein the opening in the multi-panel greeting card body, the mobile object and the infrared sensor are aligned.

11. The interactive greeting card of claim 6, wherein the mobile object is a die cut shape.

12. The interactive greeting card of claim 6, wherein the mobile object is attached to a front surface of the greeting card body.

13. The interactive greeting card of claim 6, wherein the mobile object contains at least one attachment connected to thereto at a pivot point.

14. An interactive greeting card comprising:

a greeting card body having an aperture thereon which extends through the entire greeting card body;

an infrared sensor contained within the greeting card body, the infrared sensor having an aperture therethrough;

a mobile object attached to the greeting card body, the mobile object having an aperture therethrough;

a motor contained within the greeting card body, the motor operative to cause movement to the mobile object when activated;

wherein the infrared sensor activates the motor when a finger or other object is inserted into the aperture in the greeting card body, mobile object and infrared sensor.

15. The interactive greeting card of claim 14 further comprising a sound module contained within the greeting card body, the sound module operative to save and playback at least one audio file through a speaker.

16. The interactive greeting card of claim 15, wherein the sound module is activated simultaneously with the motor.

17. The interactive greeting card of claim 14, wherein the mobile object is a die cut shape attached to a front surface of the greeting card.

18. The interactive greeting card of claim 14, wherein the motor becomes deactivated if a finger or other object is inserted into the aperture while the motor is activated.

* * * * *